US011553282B2

(12) United States Patent
Sun et al.

(10) Patent No.: US 11,553,282 B2
(45) Date of Patent: Jan. 10, 2023

(54) DIFFERENTIAL CONDENSER MICROPHONE WITH DOUBLE VIBRATING MEMBRANES

(71) Applicant: Memsensing Microsystems (Suzhou, China) Co. Ltd., Suzhou (CN)

(72) Inventors: Kai Sun, Suzhou (CN); Genlan Rong, Suzhou (CN); Wei Hu, Suzhou (CN); Gang Li, Suzhou (CN)

(73) Assignee: MEMSENSING MICROSYSTEMS (SUZHOU, CHINA) CO. LTD., Jiangsu (CN)

( * ) Notice: Subject to any disclaimer, the term of this patent is extended or adjusted under 35 U.S.C. 154(b) by 415 days.

(21) Appl. No.: 16/792,183

(22) Filed: Feb. 14, 2020

(65) Prior Publication Data

US 2020/0186940 A1 Jun. 11, 2020

Related U.S. Application Data

(63) Continuation of application No. PCT/CN2018/093033, filed on Jun. 27, 2018.

(30) Foreign Application Priority Data

Aug. 14, 2017 (CN) ..... 201710692246.3

(51) Int. Cl.

| | |
|---|---|
| ***H04R 19/04*** | (2006.01) |
| ***H04R 7/04*** | (2006.01) |
| ***H04R 19/00*** | (2006.01) |

(52) U.S. Cl.
CPC ..... *H04R 19/04* (2013.01); *H04R 7/04* (2013.01); *H04R 19/005* (2013.01); *H04R 2201/003* (2013.01)

(58) Field of Classification Search
CPC ..... H04R 19/04; H04R 7/04; H04R 19/005; H04R 2201/003
See application file for complete search history.

(56) References Cited

U.S. PATENT DOCUMENTS

| | | | | |
|---|---|---|---|---|
| 2014/0239352 | A1* | 8/2014 | Wang | H04R 19/005 257/254 |
| 2016/0221822 | A1* | 8/2016 | Krumbein | H04R 17/02 |
| 2019/0023562 | A1* | 1/2019 | Fueldner | B81C 1/00158 |

* cited by examiner

*Primary Examiner* — Fernando L Toledo
*Assistant Examiner* — Neil R Prasad
(74) *Attorney, Agent, or Firm* — Arch & Lake LLP

(57) ABSTRACT

A dual-diaphragm differential capacitive microphone includes: a back plate, a first diaphragm, and a second diaphragm. The first diaphragm is insulatively supported on a first surface of the back plate, where the back plate and the first diaphragm form a first variable capacitor. The second diaphragm is insulatively supported on a second surface of the back plate, where the back plate and the second diaphragm form a second variable capacitor. The back plate is provided with at least one connecting hole. The second diaphragm is provided with a recess portion recessed towards the back plate, where the recess portion passes through the connecting hole and is connected to the first diaphragm. The dual-diaphragm differential capacitive microphone achieves a higher signal-to-noise ratio.

13 Claims, 4 Drawing Sheets

DIFFERENTIAL CONDENSER MICROPHONE WITH DOUBLE VIBRATING MEMBRANES

CROSS-REFERENCE TO RELATED APPLICATIONS

This application is a continuation of PCT Application No. PCT/CN2018/093033, filed on Jun. 27, 2018, which claims priority to Chinese patent application No. CN201710692246.3, filed on Aug. 14, 2017, the contents of which are hereby incorporated by reference in its entirety.

TECHNICAL FIELD

The present disclosure relates to the technical field of microphones, and in particular, relates to a dual-diaphragm differential capacitive microphone.

BACKGROUND

MEMS Micro-Electro-Mechanical System (MEMS) technology is a high-tech developed in recent years, which uses advanced semiconductor manufacturing processes to realize mass production of sensors, drivers, and the like devices. Compared with corresponding conventional devices, MEMS devices have significant advantages in terms of size, power consumption, weight, and price. In the market, the main application examples of MEMS devices include pressure sensors, accelerometers and silicon microphones.

Silicon microphones made with the MEMS technology have advantages over ECM in terms of miniaturization, performance, reliability, environmental tolerance, cost and mass production capability, and quickly occupy the consumer electronics market such as mobile phones, PDAs, MP3s and hearing aids. Silicon microphones fabricated using the MEMS technology typically have a movable diaphragm disposed parallel to the solid back plate, wherein the diaphragm and the back plate forma variable capacitor. The diaphragm moves in response to incident acoustic energy to change the variable capacitance and thereby generate an electrical signal indicative of incident acoustic energy.

With the development of the capacitive micro-silicon microphone technology, silicon microphones are required to be smaller in size, lower in cost, and more reliable, and the size of silicon microphones becomes smaller, which leads to a decrease in sensitivity and a decrease in signal-to-noise ratio. How to further improve the signal-to-noise ratio of silicon microphones is an urgent problem to be solved.

SUMMARY

The present disclosure provides a dual-diaphragm differential capacitive microphone to improve a signal-to-noise ratio of a silicon microphone.

In view of the above, the present disclosure provides a dual-diaphragm differential capacitive microphone. The dual-diaphragm differential capacitive microphone includes: a back plate; a first diaphragm, insulatively supported on a first surface of the back plate, the back plate and the first diaphragm forming a first variable capacitor; a second diaphragm, insulatively supported on a second surface of the back plate, the back plate and the second diaphragm forming a second variable capacitor; wherein the back plate is provided with at least one connecting hole; and the second diaphragm is provided with a recess portion recessed towards the back plate, the recess portion passing through the connecting hole and being connected to the first diaphragm.

Other aspects and embodiments of this disclosure are also contemplated. The foregoing summary and the following detailed description are not meant to restrict this disclosure to any particular embodiment but are merely meant to describe some embodiments of this disclosure.

DETAILED DESCRIPTION

Embodiments illustrating a dual-diaphragm differential capacitive microphone according to the present disclosure are described in detail with reference to the accompanying drawings.

Figure 1:
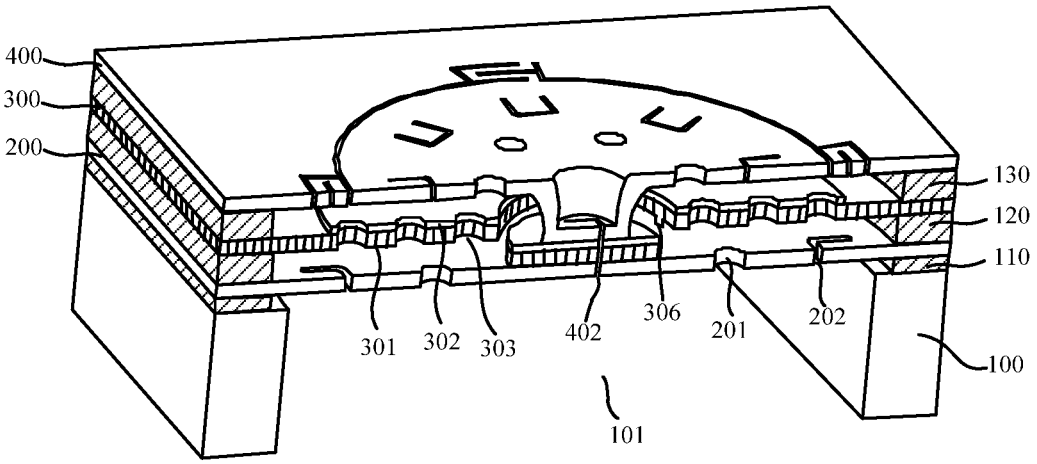
FIG. 1 is a three-dimensional sectional view of a dual-diaphragm differential capacitive microphone according to an aspect of the present disclosure.
Figure 2:
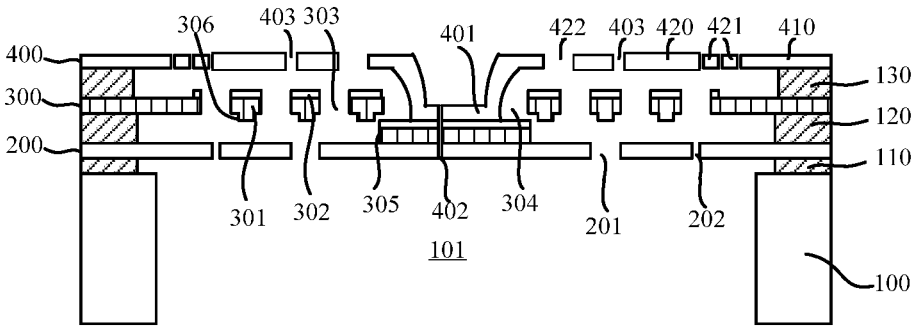
FIG. 2 is a schematic sectional view of a dual-diaphragm differential capacitive microphone according to an aspect of the present disclosure.

Referring to FIG. 1 and FIG. 2, schematic sectional views of a dual-diaphragm differential capacitive microphone according to an aspect of the present disclosure are illustrated.

The dual-diaphragm differential capacitive microphone includes: a substrate 100 having a back chamber 101; a first diaphragm 200 suspended over the back chamber 101 of the substrate 100, the first diaphragm 200 being insulatively supported on a surface of the substrate 100; a back plate 300 positioned over the first diaphragm 200, the back plate 300 being insulatively supported on the surface of the first diaphragm 200, and the back plate 300 and the first diaphragm 200 forming a first variable capacitor; and a second diaphragm 400 positioned over the back plate 300, the second diaphragm 400 being insulatively supported on a surface of the back plate 300, and the second diaphragm 400 and the back plate 300 forming a second variable capacitor.

An edge of the first diaphragm 200 is supported on the surface of the substrate 100 by a first insulating layer 110, such that the first diaphragm 200 is suspended over the back plate 101. The first insulating layer 110 may be a residual portion of a sacrificial layer upon release of the sacrificial layer in the process of forming the capacitive microphone. The first diaphragm 200 is made from a conductive material, and serves as a lower electrode of the first variable capacitor. In one or more embodiments, the first diaphragm 200 may be made from polysilicon. The first diaphragm 200 has a smaller thickness, and thus may vibrate up and down under the effect of acoustic waves, such that a capacitance of the first variable capacitor formed by the first diaphragm 200 and the back plate 300 is changed. Rigidity of the first diaphragm 200 may be regulated by regulating the thickness of the first diaphragm 200, such that sensitivity is adjusted.

The first diaphragm 200 is further provided with release apertures 201 and air leakage structures 202. In the formation of the microphone, the sacrificial layer needs to be released to form a chamber, and the release apertures 201 are configured to transport an etching solution in the process of releasing the sacrificial layer. Arrangement of the release apertures 201 may be reasonably determined according to a release path and time distribution. The air leakage structures 202 are configured to balance an air pressure within the chamber of the microphone, and prevent an over-high or over-low air pressure within the chamber of the microphone in the case of environment changes in the processing of packaging the microphone from affecting operating performance of the microphone. The air leakage structures 302 are generally uniformly and symmetrically distributed on the first diaphragm, such that the air pressure within the chamber is uniformly regulated. The release apertures 201 may also achieve the effect of regulating the air pressure.

Figure 3:
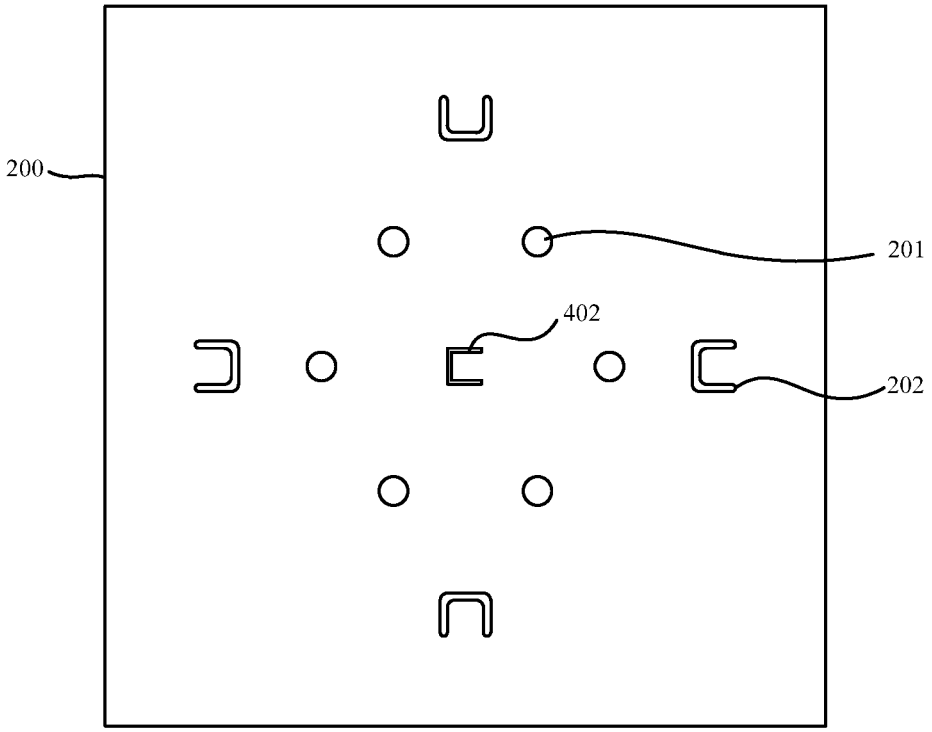
FIG. 3 is a schematic planar top view of a first diaphragm according to an aspect of the present disclosure.

Referring to FIG. 3, a schematic top view of the first diaphragm 200 according to an aspect of the present disclosure is illustrated.

The first diaphragm is provided with a plurality of release apertures 301. The release apertures 301 are circular, and uniformly and symmetrically distributed on the first diaphragm 200 along a circumferential direction. Therefore, the release apertures 301 are generally designed to be smaller, such that the case where sensitivity is reduced due to an over-small resistance caused by the first diaphragm 200 to the acoustic waves because the release apertures 301 are designed to be larger is prevented. In some embodiments of the present disclosure, the release apertures 301 may also be designed to square, triangular, polygonal, elongated slim groove-like or the like, and arrangement of the release apertures 301 may be determined according to a release path of the sacrificial layer and the time distribution.

In one or more embodiments, the air leakage structures 202 are U-shaped slim grooves, and a plurality of air leakage structures 202 are symmetrically distributed on an outer side of the first diaphragm, such that air pressures at various positions of within the chamber of the microphone are balanced. In one or more embodiments, the plurality of air leakage structures 202 are distributed on a periphery of the release apertures 301. In some embodiments of the present disclosure, the air leakage structures 202 may also be elongated stripes, crossed elongated grooves, circles, or polygonal or other shapes. The air leakage structures 202 are generally very small, such that the resistance caused by the first diaphragm 200 to the acoustic waves is not reduced.

In one or more embodiments, the first diaphragm 200 is an integral structure, with no separation structure, and is wholly fixed to the surface of the substrate 100 by a circumference of the edge to form a whole diaphragm fixing structure which features high reliability. In addition, the structure is not prone to breakage, damages or the like. The rigidity of the first diaphragm 200 may be regulated by the thickness and inner stress of the first diaphragm 200. In some embodiments of the present disclosure, support may be applied to only some positions of the edge of the first diaphragm 200.

Still referring to FIG. 1 and FIG. 2, an edge of the back plate 300 is supported on the surface of the first diaphragm 200 by a second insulating layer 120, such that the back plate 300 is suspended over the first diaphragm 200. The back plate 300 and the first diaphragm 200 form the first variable capacitor. The second insulating layer 120 may be a residual portion of the sacrificial layer upon release of the sacrificial layer in the process of forming the capacitive microphone. The back plate 300 is conductive, and serves as an upper electrode of the first variable capacitor. The back plate 300 may be a separate conductive layer, or may be a composite structure formed by an insulating layer and a conductive layer, such that hardness of the back plate 300 is improved, and deformation is prevented. In one or more embodiments, the back plate 300 includes a silicon nitride layer 301 and a polysilicon layer 302 positioned on a surface of the silicon nitride layer 301. The silicon nitride layer 301 has a higher hardness, such that the back plate 300 is used as a fixed electrode, and not prone to be deformed. In this way, reliability of the microphone is improved.

The back plate 300 may be further provided with acoustic apertures 303, such that air pressure changes within the first variable capacitor may be transferred to the second variable capacitor by the acoustic apertures 303 after the acoustic waves cause the first diaphragm; and in addition, if the acoustic waves pass through the first diaphragm 200, the acoustic waves may continuously pass through the acoustic apertures 303 and act on the second diaphragm 400, such that effective signals of the microphone are enhanced.

The back plate 300 is further provided with connecting holes 304. In one or more embodiments, since a sink portion 305 of the back plate 300 is lower than other areas of the back plate 300 and connected to the first diaphragm 200, a connecting hole 304 is formed over the sink portion 305. The connecting hole 304 mainly provides a connecting channel for the first diaphragm 200 and the second diaphragm 300. In one or more embodiments, the back plate 300 is provided with a connecting hole 304. The connecting hole 304 is positioned at a central position of the back plate, such that the second diaphragm 400 and the first diaphragm 200 are connected at the central position, and deformations at various positions are symmetrically distributed when the second diaphragm 400 and the first diaphragm 200 vibrate. In one or more embodiments, the connecting hole 304 may be circular, such that a recess portion of the second diaphragm 400 may be passed. In some embodiments of the present disclosure, the connecting hole 304 may be in other shapes, for example, polygonal, square or the like, and more than two connecting holes may be provided, which are uniformly and symmetrically distributed around the center of the back plate.

In one or more embodiments, the surface of the back plate 300 is further provided with bumps 306. In one or more embodiments, the bumps 306 are arranged in a side surface of the back plate 300 facing towards the first diaphragm 200, and when the first diaphragm 200 deforms towards the back plate 300, the bumps 306 may prevent the first diaphragm 200 from being attached to the back plate 300. In some embodiments of the present disclosure, the bumps 306 may also be arranged on both upper and lower surfaces of the back plate 300, such that the first diaphragm 200 and the second diaphragm 400 are prevented from being attached to the back plate 300.

An edge of the second diaphragm 400 is supported on the surface of the substrate 300 by a third insulating layer 130, such that the second diaphragm 400 is suspended over the back plate 300. The third insulating layer 130 may be a residue portion of the sacrificial layer upon release of the sacrificial layer in the process of forming the capacitive microphone. The second diaphragm 400 may be made of a conductive material and serve as an upper electrode of the second variable capacitor, and suspended over the back plate 300. The third insulating layer 130 may be released and sacrifice as a lower electrode of the second variable capacitor in the process of forming the microphone. In one or more embodiments, the second diaphragm 400 may be made from polysilicon. The second diaphragm 400 has a smaller thickness, and thus may vibrate up and down under the effect of acoustic waves, such that a capacitance of the second variable capacitor formed by the second diaphragm 400 and the back plate 300 is changed. Rigidity of the second diaphragm 400 may be regulated by regulating the thickness of the second diaphragm 400, such that sensitivity is adjusted.

The second diaphragm 400 is provided with a recess portion 401 that is recessed towards the back plate 300. The recess portion 401 passes through the connecting hole 304 of the back plate 300, and is insulatively connected to the first diaphragm 200. In one or more embodiments, a sink portion 305 of the back plate 300 is arranged between the recess portion 401 and the first diaphragm 200. In one or more embodiments, the back plate 300 includes the silicon nitride layer 301 and the polysilicon layer 302 positioned on the surface of the silicon nitride layer 301, such that the recess portion 404 is insulated from the first diaphragm. In some embodiments of the present disclosure, the sink portion 305 is not formed on the back plate 300, and the recess portion 401 and the first diaphragm 200 are connected by an additionally formed insulating layer. The second diaphragm 400 is connected to the first diaphragm 200, such that the second diaphragm 400 and the first diaphragm 200 may make vibration feedbacks in the same direction against the acoustic waves. In addition, the junction between the second diaphragm 400 and the first diaphragm 200 also exerts a support effect on the second diaphragm 400, such that the suspension of the second diaphragm 400 is more stable and more reliably. Furthermore, the recess portion 401 of the second diaphragm 400 serves as a portion of the first diaphragm 200, is made of the same material and has a contiguous structure, which facilitates release of the inner stress of the second diaphragm 400 and prevents introduction of a secondary stress. In this way, compliance of the second diaphragm 400 remains consistent, such that accuracy of electrical signals generated by the second diaphragm 400 under the effect of the acoustic waves. In addition, cracks, gaps or the like detects are not prone to occur between the recess portion 401 and the other parts of the second diaphragm, such that reliability of the device is improved. Since connection between the recess portion 401 and the first diaphragm 200 may not introduce the secondary stress and may not thus affect the compliance of the second diaphragm 400, the number of recess portions 401 and the positions thereof may be flexibly defined, and adaptive adjustments may be also be made according to performance requirements of the microphone. In this way, more sensitivity is achieved in the process.

In some embodiments of the present disclosure, the second diaphragm 400 may be a flat thin film, and the first diaphragm 200 is provided with a recess portion recessed towards the back plate 300. The recess portion passes through the connecting hole 304 of the back plate 300, and is insulatively connected to the second diaphragm 400.

In one or more embodiments, a junction between the recess portion 401 and the first diaphragm 200 is provided with an air leakage structure 402 passing through the recess portion 401 and the first diaphragm 200. The air leakage structure 402 may be a slim groove, an aperture, or the like pass-through structure. In some embodiments of the present disclosure, air leakage structures, as air leakage channels, are arranged on the first diaphragm 200 and the second diaphragm 400 that are arranged around the junction between the recess portion 401 and the first diaphragm 200. Compared with arranging the air leakage structures around the junction, since the air leakage structure formed at the junction directly communicates the back plate 101 and the upper part of the second diaphragm 200, the air leakage structure 402 has a shorter air leakage stroke, where a balance is needed between an inner air pressure and an outer air pressure when the microphone is encapsulated or the microphone is subjected to greater vibrations, the air pressures on both sides of the back plate 101 and the second diaphragm 400 may be balanced by the air leakage structure 402, and thus a better effect is achieved. In addition, while the first diaphragm 200 and the second diaphragm 400 are vibrating, the air leakage structure 402 may also reduce a vibration resistance. Air leakage structures 403 are further circumferentially arranged at other positions of the second diaphragm 400, and are configured to balance the air pressure and discharge the air.

Figure 4:
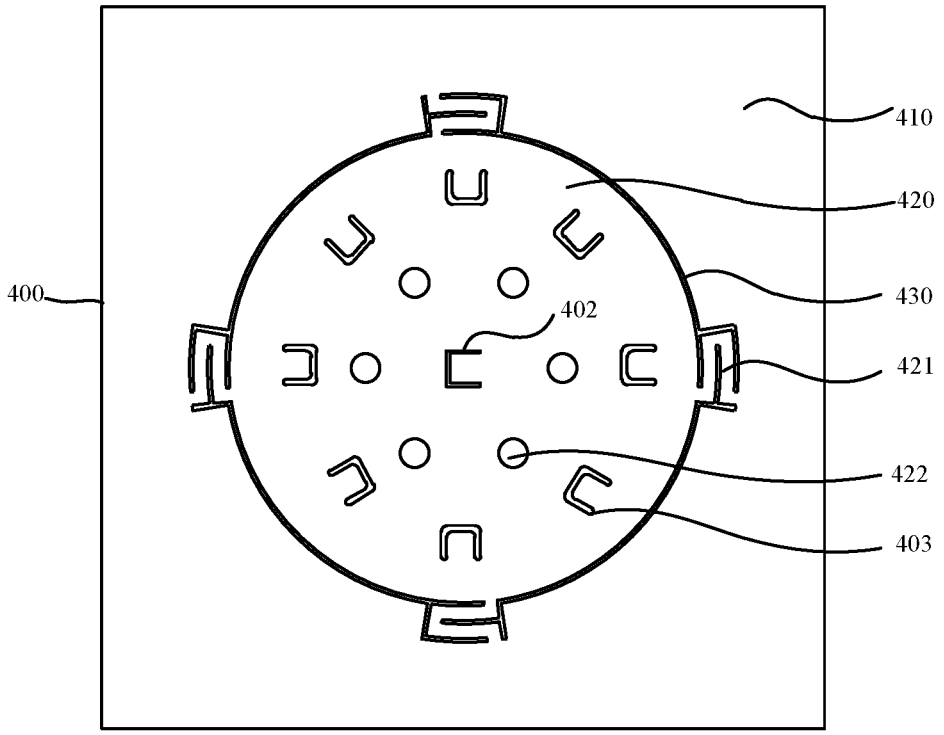
FIG. 4 is a schematic planar top view of a second diaphragm according to an aspect of the present disclosure.

With reference to FIG. 4, FIG. 4 is schematic top view of the second diaphragm 400. The second diaphragm 400 includes a second fixing portion 410 and a second vibration portion 420 enclosed by the second fixing portion 410. The second vibration portion 420 includes at least one second elastic beam 421, and a groove 430 passing through the second diaphragm 400 is arranged between the second fixing portion 410 and the second vibration portion 420. The groove 420 may serve as an air leakage structure for discharging air, and may also serve as a release groove for transporting an etching solution in the process of releasing a sacrificial layer.

In one or more embodiments, the main portion of the second vibration portion 420 except the second elastic beam 421 corresponds to the shape of the back plate 101, that is, the main portion is also circular. In some embodiments of the present disclosure, according to the performance requirements of the microphone, the main portion of the second vibration portion 420 may also be designed to other shapes. In one or more embodiments, the second vibration portion 420 includes four second elastic beams 421 which are uniformly circumferentially distributed along the main portion of the second vibration portion 420, such that the main portion of the second vibration portion 420 has a uniform stress distribution. The second elastic beam 421 is favorable to release of the inner stress of the second diaphragm 400, such that the second vibration portion 420 has a better consistency during the vibration. The rigidity of the second diaphragm 400 may be regulated by regulating the number of second elastic beams 421, the thickness of the second elastic beams 421, and the thickness of the main portion of the second vibration portion 420.

In one or more embodiments, the second elastic beam 421 is a folded beam structure. In some embodiments, the second elastic beam 421 may also employ a cantilever beam, a U-shaped beam or other beam structures. In one or more embodiments, the second diaphragm 400 is a totally-fixed bending beam diaphragm, the groove 430 isolates the main portion of the second vibration portion 420 from the second fixing portion 410, the main portion of the second vibration portion 420 is connected to the second fixing portion by the second elastic beam 421, and the second fixing portion 410 is supported by the third insulating layer 130, such that the second vibration portion 420 is suspended. However, in one or more embodiments, the recess portion 401 positioned at the center of the second vibration portion 420 is connected to the first diaphragm 200, which likewise achieves an effect of supporting the second vibration portion 420.

In one or more embodiments, the second diaphragm 400 is further provided with release apertures 422, which are specific arranged on the second vibration portion 420. The release apertures 422 are circular, and are uniformly and symmetrically distributed on the second vibration portion 420 along a circumferential direction with the center of the second diaphragm as a center of circle. The release apertures 422 are generally designed to be smaller, such that the case where sensitivity is reduced due to an over-small resistance caused by the second diaphragm 400 to the acoustic waves because the release apertures 422 are designed to be larger is prevented. In some embodiments of the present disclosure, the release apertures 422 may also designed to be square, triangular, polygonal, elongated slim groove-like or the like shapes, and arrangement of the release apertures 301 may be determined according to a release path of the sacrificial layer and the time distribution. The air leakage structures 403 are positioned on a periphery of the release apertures 422.

In some embodiments of the present disclosure, the second diaphragm 400 may also be an entire totally-fixed diaphragm, and the second diaphragm may be entirely and totally fixed and supported on the surface of the back plate by a circumference of the edge or some positions on the edge of the second diaphragm 400 are supported. In this case, the rigidity of the second diaphragm 400 may be adjusted by the thickness of the second diaphragm 400 and the inner stress thereof.

Figure 5:
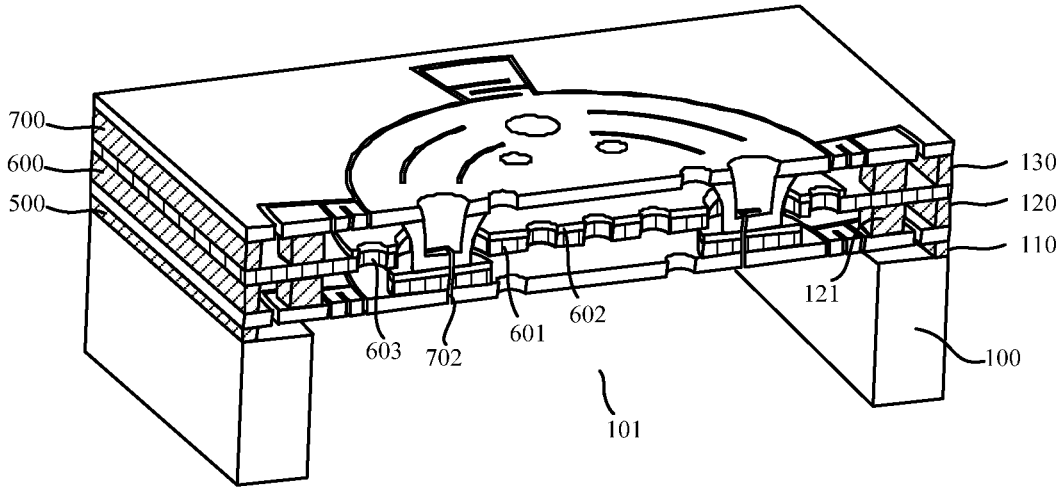
FIG. 5 is a three-dimensional sectional view of the dual-diaphragm differential capacitive microphone according to an aspect of the present disclosure.
Figure 6:
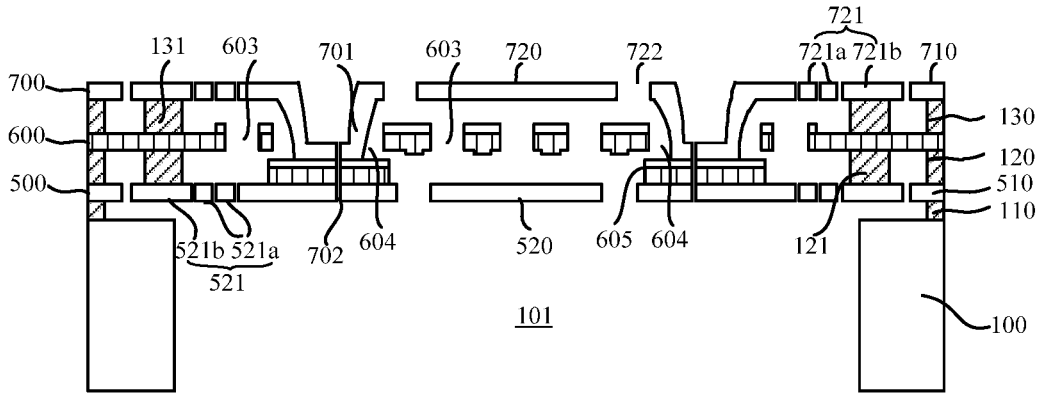
FIG. 6 is a schematic sectional view of the dual-diaphragm differential capacitive microphone according to an aspect of the present disclosure.

Referring to FIG. 5 and FIG. 6, schematic sectional views of a dual-diaphragm differential capacitive microphone according to some embodiments of the present disclosure are given.

In one or more embodiments, a first diaphragm 500 of the microphone includes a first fixing portion 510 and a first vibration portion 520 enclosed by the first fixing portion 510, wherein the first vibration portion 520 includes at least one first elastic beam 521. A groove 530 passing through the first diaphragm 500 is arranged between the first fixing portion 510 and the first vibration portion 520. The groove 530 may serve as an air leakage structure for discharging air, and may also serve as a release groove for transporting an etching solution in the process of releasing a sacrificial layer.

Figure 7:
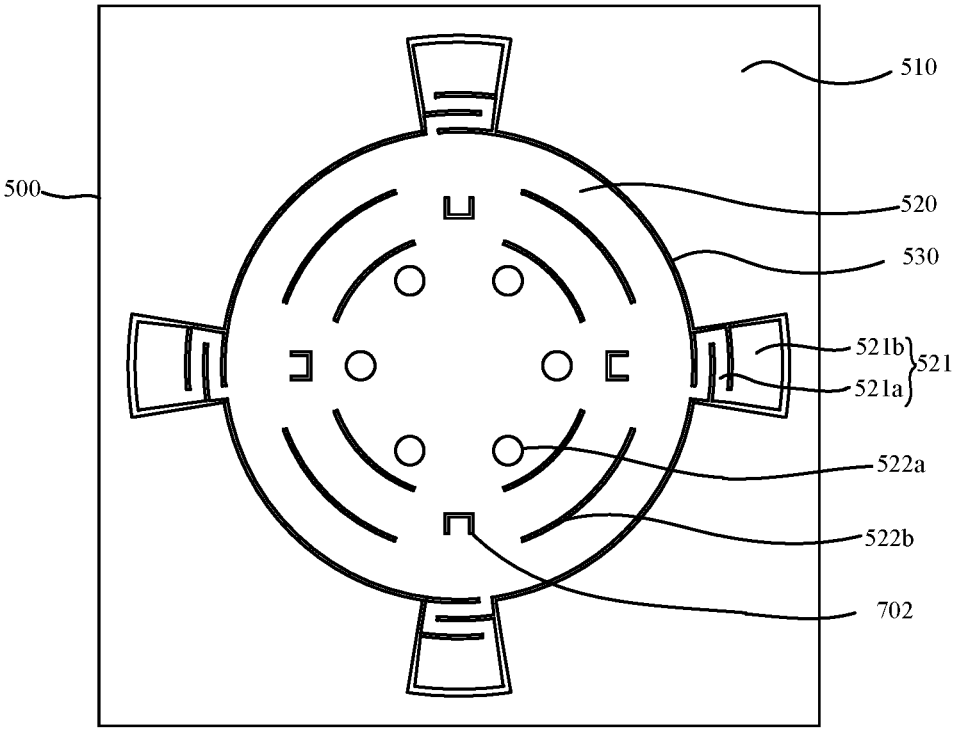
FIG. 7 is a schematic planar top view of the first diaphragm according to an aspect of the present disclosure.

With reference to FIG. 7, FIG. 7 is schematic top structural view of the first diaphragm 500. The main portion of the first vibration portion 500 except the first elastic beam 521 corresponds to the shape of the back plate 101, that is, the main portion is also circular. In some embodiments of the present disclosure, according to the performance requirements of the microphone, the main portion of the first diaphragm 520 may also be designed to other shapes. In one or more embodiments, the first vibration portion 520 includes four first elastic beams 521 which are uniformly circumferentially distributed along the main portion of the first vibration portion 520. The first elastic beam 521 is favorable to release of the inner stress of the first diaphragm 500, such that the first vibration portion 520 has a better consistency during the vibration. The rigidity of the first diaphragm 500 may be adjusted by regulating the number of first elastic beams 521, the thickness of the first elastic beams 520, and the thickness of the main portion of the first vibration portion 420.

In one or more embodiments, the first elastic beam 521 is a folded beam structure. In some embodiments, the first elastic beam 521 may also employ a cantilever beam, a U-shaped beam or other beam structures. In one or more embodiments, the first diaphragm is a partially-fixed bending beam diaphragm, and the groove 530 totally isolates the first vibration portion 520 from the first fixing portion 510, such that the first vibration portion 520 is totally isolated from the first fixing portion 510. The first fixing portion 510 is supported on the surface of the substrate 100 by the first insulating layer 110. The first elastic beam 521 includes a suspension beam 521*a* and an anchor 521*b*. An upper part of the anchor 521*b* is connected to a back plate 600 by an insulating layer 121, such that the first vibration portion is suspended on the back plate 600 and suspended over the back chamber 101. By increasing the number of first elastic beams 521, reliability of connection between the first vibration portion 520 and the back plate 600 may be improved. Further, a lower part of the anchor 521*b* is supported on the surface of the substrate 100 by an insulating layer.

In some embodiments, the second diaphragm 500 may also be a totally-fixed bending beam diaphragm, the groove 530 isolates the main portion of the first vibration portion 520 from the first fixing portion 510, the main portion of the first vibration portion 520 is connected to the first fixing portion by the first elastic beam 521, and the first fixing portion 510 is supported by the first insulating layer 110, such that the first vibration portion 520 is suspended.

In one or more embodiments, the first diaphragm 500 may be further provided with release apertures 522*a* and a release grooves 522*b*. Specifically, the release apertures 522*a* and the release grooves 522*b* are both arranged on the first vibration portion 520. The release apertures 522*a* are designed to be circular, and are uniformly and symmetrically distributed around the center of the first vibration portion 520 in a circumferential direction. The release grooves 522*b* are designed to the arc-shaped, and are symmetrically distributed on a periphery of the release apertures 522*a*, such that efficiency and uniformity of releasing a sacrificial layer in the process of forming the microphone are improved. The release apertures 522*a* and the release groove 522*b* may also server as air leakage structures after the microphone is formed.

An edge of the back plate 600 is supported on the surface of the first diaphragm 500 by the second insulating layer 120, such that the back plate 600 is suspended over the first diaphragm 500. The back plate 600 and the first diaphragm 500 form a first variable capacitor, the back plate 600 serves as an upper electrode, and the first diaphragm serves as a lower electrode. The back plate 600 may be a separate conductive layer, or may be a composite structure formed by an insulating layer and a conductive layer, such that hardness of the back plate 600 is improved, and deformation is prevented. In one or more embodiments, the back plate 600 includes a silicon nitride layer 601 and a polysilicon layer 601 positioned on a surface of the silicon nitride layer 602.

The back plate 600 may be further provided with acoustic apertures 603, such that air pressure changes within the first variable capacitor may be transferred to the second variable capacitor by the acoustic apertures 603 after the acoustic waves cause the first diaphragm; and in addition, if the acoustic waves pass through the first diaphragm 500, the acoustic waves may continuously pass through the acoustic apertures 603 and act on the second diaphragm 700, such that effective signals of the microphone are enhanced.

The back plate 600 may be provided with a plurality of connecting holes 605. In one or more embodiments, four connecting holes 4 are arranged, and are symmetrically and uniformly distributed on the back plate 600 with the center of the back plate 600 as a circle of center, over the first vibration portion 520. In some embodiments of the present disclosure, two, three, five, more any other quantities of connecting holes may also be arranged on a periphery of the center of the back plate 600.

Figure 8:
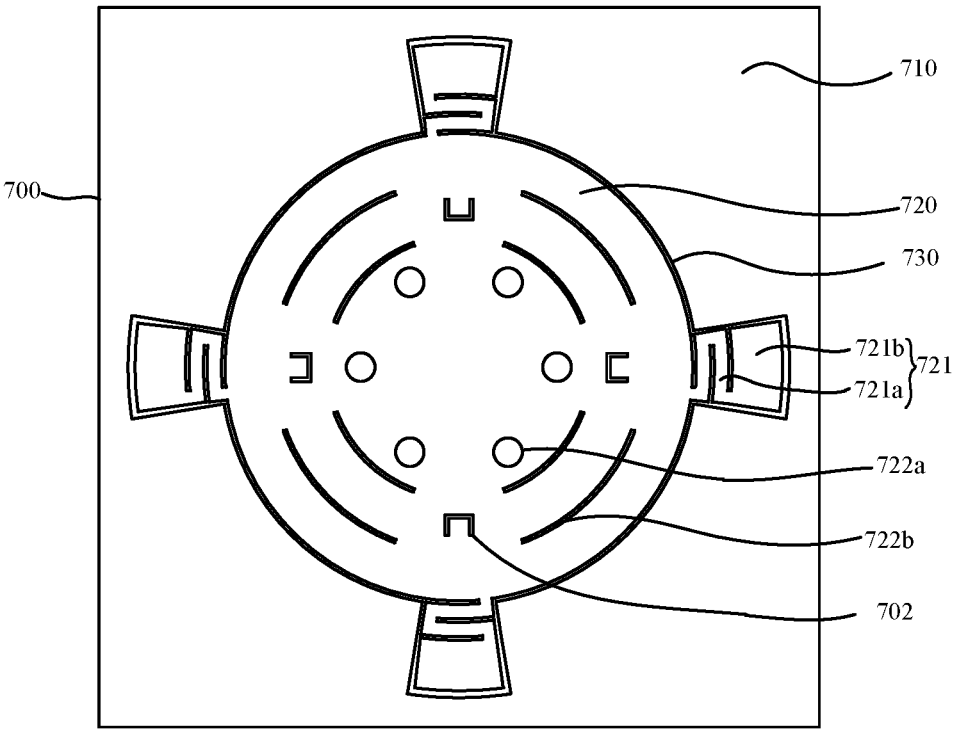
FIG. 8 is a schematic planar top view of the second diaphragm according to an aspect of the present disclosure.

With reference to FIG. 8, the second diaphragm 700 includes a second fixing portion 710 and a second vibration portion 7420 enclosed by the second fixing portion 710. The second vibration portion 720 includes at least one second elastic beam 721, and a groove 730 passing through the second diaphragm 400 is arranged between the second fixing portion 710 and the second vibration portion 720. The groove 730 may serve as an air leakage structure for discharging air, and may also serve as a release groove for transporting an etching solution in the process of releasing a sacrificial layer.

In one or more embodiments, the second vibration portion 720 includes four second elastic beams 721, which are uniformly distributed on the main portion of the second vibration portion along a circumferential direction. In one or more embodiments, the second elastic beam 721 is a folded beam structure. In some embodiments, the second elastic beam 721 may also employ a cantilever beam, a U-shaped beam or other beam structures. In one or more embodiments, the second diaphragm is a partially-fixed bending beam diaphragm, and the groove 730 totally isolates the second vibration portion 720 from the second fixing portion 710, such that the second vibration portion 720 is totally isolated from the second fixing portion 710. The second fixing portion 710 is supported on the surface of the back plate 600 by the third insulating layer 130. The second elastic beam 721 includes a suspension beam 521*a* and an anchor 521*b*. The anchor 721*b* is connected to the back plate 600 by the beneath insulating layer 131, such that the second vibration portion 720 is supported and suspended over the back plate 600. The second diaphragm 700 and the back plate 600 form a second variable capacitor, the back plate 600 serves as a lower electrode of the second variable capacitor, and the second diaphragm 700 serves as an upper electrode of the second variable capacitor.

The second diaphragm 700 is provided with a recess portion recessed towards the back plate 600. The number of recess portions 710 and the positions of the recess portions correspond to the number of connecting holes 604 and the positions of the connecting holes on the back plate 600. The recess portion 701 passes through the connecting hole 604 on the back plate 600, and is insulatively connected to the first diaphragm 500. The number of recess portions 701 and the positions of the recess portions correspond to those of connecting holes 604 on the back plate 600. The recess portion is connected to the first diaphragm 200 by a sink portion 605 of the back plate 600. The back plate 600 includes a silicon nitride layer 601 and a polysilicon layer 602 positioned on a surface of the silicon nitride layer, such that the recess portion 701 is insulatively connected to the first diaphragm 500. In some embodiments of the present disclosure, the sink portion 605 is not formed on the back plate 600, and the recess portion 701 and the first diaphragm 500 may also connected by an additionally formed insulating layer. The second diaphragm 700 is connected to the first diaphragm 500, such that the second diaphragm 700 and the first diaphragm 500 may make vibration feedbacks in the same direction against the acoustic waves. In addition, the junction between the second diaphragm 700 and the first diaphragm 500 also exerts a support effect on the second diaphragm 700, such that the suspension of the second diaphragm 700 is more stable and more reliably. In addition, by connecting the recess portion 701 of the second diaphragm 700 to the first diaphragm 500, introduction of a secondary stress may be prevented, an inner stress of the second diaphragm 700 may be conveniently released, and thus reliability and accuracy of the device may be improved.

In one or more embodiments, a junction between the recess portion 701 and the first diaphragm 500 is provided with an air leakage structure 702 passing through the recess portion 701 and the first diaphragm 500. In some embodiments of the present disclosure, air leakage structures, as air leakage channels, are arranged on the first diaphragm 500 and the second diaphragm 701 that are arranged around the junction between the recess portion 700 and the first diaphragm 500. Compared with arranging the air leakage structures around the junction, since the air leakage structure 702 formed at the junction a shorter air leakage stroke, air discharge is quicker and a better effect is achieved.

Optionally, only one connecting hole is provided and positioned at a central position of the back plate.

Optionally, more than two connecting holes are provided and uniformly and symmetrically distributed around a central position of the back plate.

Optionally, a junction between the recess portion and the first diaphragm is provided with an air leakage structure passing through the recess portion and the first diaphragm.

Optionally, the first diaphragm and/or the second diaphragm are an integral diaphragm structure.

Optionally, the first diaphragm includes a first fixing portion arranged on an edge thereof and a first vibration portion enclosed by the first fixing portion, the first vibration portion including at least one first elastic beam, the first fixing portion being connected to the first vibration portion by the first elastic beam, or the first fixing portion being absolutely isolated from the first vibration portion.

Optionally, the first elastic beam is insulatively connected to the back plate, such that the first vibration portion is suspended over the first surface of the back plate.

Optionally, the second diaphragm includes a second fixing portion arranged on an edge thereof and a second vibration portion enclosed by the second fixing portion, the second vibration portion including at least one second elastic beam, the second fixing portion being connected to the second vibration portion by the second elastic beam, or the second fixing portion being absolutely isolated from the second vibration portion.

Optionally, the second elastic beam is insulatively connected to the back plate, such that the second vibration portion is suspended over the second surface of the back plate.

Optionally, the back plate is provided with an acoustic aperture, and the surface of the back plate is provided with a bump.

Optionally, the first diaphragm and/or the second diaphragm are both provided with a release aperture and an air leakage structure.

In the dual-diaphragm differential capacitive microphone according to the present disclosure, a first diaphragm and a back plate form a first capacitor, the back plate and a second diaphragm form a second capacitor, and the first capacitor and the second capacitor form a differential capacitor. During the operation, a differential signal is output. In this way, sensitivity may be improved, and signal-to-noise ratio may be improved. In addition, a recess portion of the second diaphragm is insulatively connected to the first diaphragm, such that the second diaphragm and the first diaphragm may vibrate in the same direction, such that accuracy of signals is improved. In addition, the recess portion of the second diaphragm, as a portion of the second diaphragm, not only achieves a support effect, but also facilitates an inner stress of the second diaphragm and prevents introduction of a secondary stress. In this way, cracks, gaps or the like detects are not prone to occur between the recess portion and the other parts of the second diaphragm, such that reliability of the device is improved.

The first diaphragm and the second diaphragm may be designed to have a plurality of structural forms, which may be any of structures including a totally-fixed diaphragm, a partially-fixed bending beam diaphragm, a totally-fixed bending beam diaphragm, and the like. Furthermore, a junction between the second diaphragm and the first diaphragm may be provided with an air leakage structure, such that air leakage efficiency of the air leakage structure may be improved, and reliability of the microphone may be enhanced.

In the above embodiments, in the microphone, a first diaphragm and a back plate form a first capacitor, the back plate and a second diaphragm form a second capacitor, and the first capacitor and the second capacitor form a differential capacitor. During the operation, a differential signal is output. In this way, sensitivity may be improved, and signal-to-noise ratio may be improved. In addition, the first diaphragm is connected to the second diaphragm, such that the second diaphragm and the first diaphragm may vibrate in the same direction, such that accuracy of signals is improved.

The first diaphragm and the second diaphragm may be designed to have a plurality of structural forms, which may be any of structures including a totally-fixed diaphragm, a partially-fixed bending beam diaphragm, a totally-fixed bending beam diaphragm, and the like. Furthermore, a junction between the second diaphragm and the first diaphragm may be provided with an air leakage structure, such that air leakage efficiency of the air leakage structure may be improved, and reliability of the microphone may be enhanced.

Described above are preferred examples of the present disclosure. It should be noted that persons of ordinary skill in the art may derive other improvements or polishments without departing from the principles of the present disclosure. Such improvements and polishments shall be deemed as falling within the protection scope of the present disclosure.

What is claimed is:

1. A dual-diaphragm differential capacitive microphone, comprising:

a back plate provided with at least one connecting hole;

a first diaphragm, insulatively supported on a first surface of the back plate, the back plate and the first diaphragm forming a first variable capacitor; and a second diaphragm, insulatively supported on a second surface of the back plate, the back plate and the second diaphragm forming a second variable capacitor, wherein the second diaphragm is provided with a recess portion recessed towards the back plate, wherein the recess portion passes through the connecting hole and is connected to the first diaphragm through a sink portion of the back plate or an insulating layer, and wherein the sink portion is located between the recess portion and the first diaphragm and is located lower than other areas of the back plate.

2. The dual-diaphragm differential capacitive microphone according to claim 1, wherein only one connecting hole is provided and positioned at a central position of the back plate.

3. The dual-diaphragm differential capacitive microphone according to claim 1, wherein more than two connecting holes are provided and uniformly and symmetrically distributed around a central position of the back plate.

4. The dual-diaphragm differential capacitive microphone according to claim 1, wherein more than two connecting holes are provided and uniformly and symmetrically distributed around a central position of the back plate.

5. The dual-diaphragm differential capacitive microphone according to claim 1, wherein a junction between the recess portion and the first diaphragm is provided with an air leakage structure passing through the recess portion and the first diaphragm.

6. The dual-diaphragm differential capacitive microphone according to claim 1, wherein the first diaphragm and/or the second diaphragm are an integral diaphragm structure.

7. The dual-diaphragm differential capacitive microphone according to claim 1, wherein the first diaphragm comprises a first fixing portion arranged on an edge thereof and a first vibration portion enclosed by the first fixing portion, the first vibration portion comprising at least one first elastic beam, the first fixing portion being connected to the first vibration portion by the first elastic beam, or the first fixing portion being absolutely isolated from the first vibration portion.

8. The dual-diaphragm differential capacitive microphone according to claim 6, wherein the first elastic beam is insulatively connected to the back plate, such that the first vibration portion is suspended over the first surface of the back plate.

9. The dual-diaphragm differential capacitive microphone according to claim 1, wherein the second diaphragm comprises a second fixing portion arranged on an edge thereof and a second vibration portion enclosed by the second fixing portion, the second vibration portion comprising at least one second elastic beam, the second fixing portion being connected to the second vibration portion by the second elastic beam, or the second fixing portion being absolutely isolated from the second vibration portion.

10. The dual-diaphragm differential capacitive microphone according to claim 8, wherein the second elastic beam is insulatively connected to the back plate, such that the second vibration portion is suspended over the second surface of the back plate.

11. The dual-diaphragm differential capacitive microphone according to claim 1, wherein the back plate is provided with an acoustic aperture, and the surface of the back plate is provided with a bump.

12. The dual-diaphragm differential capacitive microphone according to claim 1, wherein the first diaphragm and/or the second diaphragm are both provided with a release aperture and an air leakage structure.

13. The dual-diaphragm differential capacitive microphone according to claim 3, wherein a junction between the recess portion and the first diaphragm is provided with an air leakage structure passing through the recess portion and the first diaphragm.

* * * * *